US006849311B2

(12) United States Patent
Yoshinari et al.

(10) Patent No.: US 6,849,311 B2
(45) Date of Patent: Feb. 1, 2005

(54) THERMAL TRANSFER SHEET AND THERMAL TRANSFER RECORDING METHOD

(75) Inventors: Shinichi Yoshinari, Shizuoka-ken (JP); Akira Hatakeyama, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 188 days.

(21) Appl. No.: 09/859,461

(22) Filed: May 18, 2001

(65) Prior Publication Data

US 2001/0056039 A1 Dec. 27, 2001

(30) Foreign Application Priority Data

May 19, 2000 (JP) ..... 2000-148433

(51) Int. Cl.[7] ..... B41M 5/40

(52) U.S. Cl. ..... 428/32.72; 428/32.52; 428/32.64; 428/32.68; 428/32.81; 428/32.87

(58) Field of Search ..... 428/195, 484, 428/488.1, 488.4, 913, 914, 32.8, 32.81, 32.52, 32.64, 32.68, 32.72, 32.87

(56) References Cited

U.S. PATENT DOCUMENTS

| | | | | | |
|---|---|---|---|---|---|
| 4,784,905 | A | | 11/1988 | Suzuki et al. | 428/321.3 |
| 4,792,860 | A | * | 12/1988 | Kuehrle | 358/300 |
| 5,716,477 | A | * | 2/1998 | Yamaguchi et al. | 156/230 |
| 5,817,264 | A | * | 10/1998 | Hsieh | 264/131 |
| 5,935,902 | A | | 8/1999 | Imamura | |

FOREIGN PATENT DOCUMENTS

EP 0 799 714 A1 10/1997

OTHER PUBLICATIONS

Japanese Abstract No. 09052458, dated Feb. 25, 1997.
Japanese Abstract No. 09142044, dated Jun. 3, 1997.
Japanese Abstract No. 09169165, dated Jun. 30, 1997.

* cited by examiner

*Primary Examiner*—Bruce H. Hess
(74) *Attorney, Agent, or Firm*—Sughrue Mion, PLLC

(57) ABSTRACT

A thermal sheet transfer having on a support, an image formation layer wherein the image formation layer includes as a colorant, an organic pigment having a melting point not less than 310° C.

17 Claims, No Drawings

THERMAL TRANSFER SHEET AND THERMAL TRANSFER RECORDING METHOD

BACKGROUND OF THE INVENTION

1. Field of the Invention

The present invention relates to a thermal transfer sheet used in an image formation method wherein laser light is used to form high resolution images. Specifically, the present invention relates to a thermal transfer sheet that prevents decreased optical density and deterioration of hues caused by large amounts of heat generated by laser light.

2. Description of the Related Art

Conventionally, a thermal transfer sheet in which a light-heat conversion layer which absorbs laser light and generates heat and also includes light-heat conversion dyestuff such as those which absorb infrared light, and an image formation layer into which a colorant is dispersed, are disposed in that order on a support, is known as a recording material used in a transfer image formation method in which laser light is used. Examples of the thermal transfer sheet include a sublimation-type transfer sheet in which a sublimation dye is used in an image formation layer and a melt-type thermal sheet containing an organic pigment which can melt. In these thermal transfer sheets, at the time of recording, large amounts of heat generated by the laser light may cause the colorants in the image formation layer to decompose, and as a result optical density may decrease and the desired hues cannot be obtained.

In an attempt to solve these problems, a sublimation-type thermal transfer sheets in which sublimation dyes having specific structures and which do not decompose due to heat generated at the time of recording are disclosed in the specifications of Japanese Patent Nos. 2676541, 2759814, 2893270, 2893271, 2893272, and 2829671.

However, physical properties of the image formation layers, which physical properties are required of the melt-type thermal transfer sheet, are different from those of the sublimation-type thermal transfer sheet in which organic pigments are used in the image formation layers. As a result, the problem that at the time of recording, optical density may decrease and the desired hues cannot be obtained remains unsolved in the melt-type thermal transfer sheets.

SUMMARY OF THE INVENTION

In view of the above-described problems, an object of the present invention is to provide a thermal transfer sheet in which reduced optical density and deterioration of the desired hue caused by heat generated at the time of recording is prevented.

A first aspect of the invention is a thermal transfer sheet comprising at least an image formation layer disposed on a support, wherein the image formation layer includes an organic pigment having a melting point not less than 310° C.

A second aspect of the invention is a thermal transfer sheet comprising at least an image formation layer disposed on a support, wherein the heat resistance of the image formation layer according to the DIN 54001 standard is not less than 200° C.

A third aspect of the invention is a thermal transfer recording method wherein in an image receiving sheet comprising at least a cushion layer and an image receiving layer disposed on a porous support, the above-mentioned transfer sheets are used to record images.

In the present invention, by using an organic pigment having specific physical properties as a colorant in the image formation layer, decomposition of the organic pigment, which decomposition is the cause of decreased optical density and hue deterioration, is prevented.

DETAILED DESCRIPTION OF THE PREFERRED EMBODIMENTS

Hereinafter, the present invention is described in detail. The thermal transfer sheet of the present invention has disposed on a support, at least an image formation layer having an organic pigment with specific physical properties as its colorant.

Thermal Transfer Sheet

Support

The support may be formed of any material, provided that dimensional stability is good and it is resistant to heat generated at the time of recording. Specific examples of the materials include: synthetic resin materials such as polyethylene terephthalate (PET), polyethylene-2,6-naphtalene, polycarbonate, polyethylene, polyvinyl chloride, polyvinylidene chloride, polystyrene, styrene-acrylonitrile copolymers. Among these, biaxially oriented polyethylene terephthalate is preferable in consideration of mechanical strength and dimensional stability in the presence of heat.

Further, if an image is formed by irradiating the laser light from the support side, it is preferable that the support is transparent. However, if the image is formed by irradiating the laser light from the image formation layer side, the support does not need to be transparent.

In order to improve adhesive properties between the support and the image receiving sheet, the support may have cushioning properties. In that case, a material having a low modulus of elasticity or a substance having rubber elasticity may be used as the support. Specific examples of these materials include: elastomers such as natural rubber, acrylate rubber, butyl rubber, nitrile rubber, butadiene rubber, isoprene rubber, styrene-butadiene rubber, chloroprene rubber, urethane rubber, silicone rubber, acrylic rubber, fluororubber, neoprene rubber, chlorosulphonated polyethylene, epichlorohydrin, EPDM, urethane elastomer and the like; resins having a low modulus of elasticity among which are some polyethylenes, polypropylenes, polybutadienes, polybutenes, impact resistant ABS resins, polyurethanes, ABS resins, acetates, cellulose acetates, amide resins, polytertrafluoroethylenes, nitrocelluloses, polystyrenes, epoxy resins, phenol-formaldehyde resins, polyesters, impact resistant acrylic resins, styrene-butadiene copolymers, ethylene-vinyl acetate copolymers, acrylonitrile-butadiene copolymers, vinyl chloride-vinyl acetate copolymers, polyvinyl acetates, vinyl chloride resins with a plasticizer, vinylidene chloride resins, polyvinyl chlorides, and polyvinylidene chlorides. The materials having a low modulus of elasticity and the materials having rubber elasticity may be added to the base material of the support. Further, shape memory resins such as a styrene hybrid polymers in which a polynorbornane unit, or a polybutadiene unit is compounded with a polystyrene unit may also be used.

The thickness of the support is not particularly limited, but is usually 2–300 $\mu$m and preferably 5–200 $\mu$m. The thickness of the cushioning support varies according to various factors such as the type of resin or elastomer used, the suction power at the time of superposing, the particle diameter of the matting agent, and the amount of matting agent used, and thus cannot be unconditionally specified. However, the thickness is usually 10–100 $\mu$m.

Further, at the side of the support opposite that at which the light-heat conversion layer has been provided, a back coat may be provided which imparts stability at the time of movement, heat resistance, anti-static properties and the like. The back coat layer is formed by coating the surface of the support with a back coat layer coating solution. This back coat layer coating solution is obtained by dissolving a resin such as nitrocellulose in a solvent, or by dissolving or dispersing a binder resin and 20–30 μm particles in a solvent.

Image Formation Layer

Colorant

The present invention relates to a thermal transfer sheet for use in a melt-type thermal transfer method. Further, the image formation layer is one which melts or soften when heated and is thereby transferred to the image receiving material.

The colorant included in the image formation layer is usually a pigment or a dye. Pigments are generally divided into organic pigments and inorganic pigments, the former being particularly excellent for transparency of the coated film and the latter being excellent in concealing properties. In the present invention, by using as a colorant an organic pigment having particular physical properties, the image formation layer may be made heat resistant. Thus, heat decomposition of the organic pigment caused by high temperature of the laser light at the time of recording is controlled, and decrease of the optical density and deterioration of the hue can be prevented.

In the present invention, an organic pigment having a melting point greater than or equal to 310° C. is used. Examples of an organic pigment having a melting point greater than or equal to 310° C. include: a compound having an isoindoline ring; a compound having a benzimidazolone ring, a condensed azo compound and the like. An organic pigment having a melting point greater than or equal to 335° C., such as a compound having an isoindoline ring is preferable. More preferable is an organic pigment having a melting point greater than or equal to 345° C., such as a compound having a benzimidazolone ring. Incidentally, organic pigments become more preferable for use as their melting points increase.

Specific examples of the organic pigment used in the present invention include Permanent Yellow GG02, Noveperm Yellow H2G, Noveperm Yellow M2R70, Noveperm Yellow 5GD, Noveperm YellowP-HG and the like.

When the thermal transfer sheet of the present invention is used in a color proof for printing, an organic pigment whose hue coincides with or is near yellow, magenta, cyan or black is preferably used.

Further, the organic pigment used as the colorant should be one in which heat resistance according to DIN 54001 is not less than 200° C. and preferably not less than 220° C.

DIN is an acronym for Deutsches Insditutfür Normung and the heat resistance in accordance with DIN54001 is based on the following standard. Firstly, ink comprising the respective pigments and an alkyd resin is manufactured. Printing is then carried out on metal plate with 1.5 g/m$^2$ of ink. Subsequently, the metal plate on which printing has been carried out is left at 140° C. for 10 minutes and then visually observed for color changes. If there are no color changes, the temperature is increased by 20° C. at a time and the temperature a time when color change of rank 3 of the Grey Scale is observed, is considered the limit for heat resistance.

Further, the amount of the organic pigment included in the image formation layer is preferably 30% to 70% by weight, and more preferably 30% to 60% by weight. If the amount of organic pigment included in the image formation layer is increased, optical density is increased. However, if the amount of the organic pigment is equal to or greater than 70% by weight, a rubbing force generated on the surface of image formation layer becomes large. This rubbing force may cause the thermal transfer sheet to shift, or may cause peeling and the like at the surface of the image formation layer at the time of recording, and as a result adversely affect conveyance. From this viewpoint, even when the organic pigment is used in low amounts, one whose optical density is comparatively high, and whose coloring ability is high is preferably used. Specifically, a disazo compound having a benzimidazolone ring and the like is preferable.

The thermal transfer sheet of the present invention may include two or more types of organic pigments in the image formation layer. In this case, the two or more types of organic pigments included may have a melting point greater than or equal to 310° C. Organic pigments having a melting point less than 310° C. may also be included. In a case where the organic pigment having a melting point of not less than 310° C. and the organic pigment having a melting point of less than 310° C. are included, the amount of the organic pigment having a melting point not less than 310° C. is preferably 75%, more preferably 85%, and further preferably 90% by weight based on the total amount of the organic pigments.

Binder

The binder to be used in the image formation layer may include: a substance which melts when heated; a substance which softens when heated; and a thermoplastic resin. The substance which melts when heated is usually one which is a solid or semi-solid substance whose melting point is in the range of 40–150° C. when measured using the Yanagimoto MJP-2 apparatus.

Specific examples of the substance which melt upon heating include: vegetable waxes such as carnauba wax, Japan wax, oliqury wax, and espar wax; animal wax such as bees wax, insect wax, shellac wax, and spermaceti; petroleum waxes such as paraffin wax, microcrystalline wax, polyethylene wax, ester wax and acid wax; and mineral waxes such as montan wax, ozokerite and ceresine. In addition to these wax types, higher fatty acids such as palmitic acid, stearic acid, margaric acid and behenic acid; higher alcohols such as palmityl alcohol, stearyl alcohol, behenyl alcohol, marganyl alcohol, myricyl alcohol and eicosanol; high fatty acid esters such as cetyl palmate, myricyl plamate, cetyl stearate, and myricyl stearate; amides such as acetamide, propionic acid amide, palmytic acid amide, stearic acid amide, and amide wax; and higher fatty amines such as stearylamine, behenylamine, palmitylamine. These may be used singly or in combination.

Specific examples of the substance having heat softening properties include: waxes such as vegetable wax, animal wax, petroleum wax, mineral wax and the like. Further, as well as these waxes the substance may include higher fatty acid, higher alcohols, higher fatty esters, amides, higher amines, and the like.

Amorphous Organic Polymer

An amorphous organic polymer having a softening point of 40–150° C. is preferably used. Examples of the amorphous organic polymers include: polyvinyl butyral resin; butyral resin; polyamide resin; polyethylene imine resin; sulfonamide resin; polyester polyol resin; petroleum resin; homopolymer and copolymers of styrenes and derivatives thereof such as styrene, vinyltoluene, α-methylstyrene, 2-methylstyrene, chlorostyrene, vinylbenzoic acid, sodium vinylbenzenesulfonate, aminostyrene; homopolymers of vinyl and vinyl derivatives and copolymers of vinyl and vinyl derivatives (e.g. metacrylates such as methyl metacrylate, ethyl metacrylate, butyl metacrylate, hydroxyethyl metacrylate, and metacrylic acid acrylates such as methyl acrylate, ethyl acrylate, butyl acrylate, α-ethylhexyl acrylate and acrylic acid, dienes such as butadiene and isoprene, acrylonitrile, vinyl eters, maleic acid and maleic acid esters, maleic anhydride, cinnamic acid, vinyl chloride, and vinyl acetate) and other monomers. These resins may used in combinations of two or more.

Examples of the thermoplastic resin include polymers having a melting point of 50–150° C. such as: resins such as copolymer of ethylene and/or derivatives thereof, polyamide resins, polyester resins, polyurethane resin, polyolefin resins, acrylic resins, vinyl chloride resins, cellulose resins, rosin resins, ionomer resins, petroleum resins and the like; elastomers such as natural rubber, styrene-butadiene rubber, isoprene rubber, chloroprene rubber and the like; rosin derivatives such as ester gum, rosin-maleic acid resin, rosin-phenol resin and hydrogenated rosin; and phenol resin, terpene resin, cyclopentadiene resin and aromatic hyrocarbons.

Of the binders, an amorphous organic polymer having a softening point of 40–150° C. is preferably used. The amount of the amorphous organic polymer included in the image formation layer is 30–70% and more preferably 40–60% by weight.

In addition to the above components, the image formation layer may further include, a surfactant, organic or inorganic particles (metal particles, silica gel, etc.), oils (linseed oil, mineral oil, etc.) and the like. Except for when obtaining black images, by including a substance which absorbs the wavelength of the light source used for recording an image, the amount of energy required for transfer can be reduced. The substance for absorbing the wavelength of the light source can be either a pigment or a dye. However, when a color image is to be obtained, it is preferable to use an infrared light source such a semiconductor laser for image recording, and to use a dye which absorbs a large amount of the wavelength of the light source and a small amount of the visible portion, from the viewpoint of color reproduction. Examples of the near infrared light dye include those compounds disclosed in Japanese Patent Application-Laid Open No. 3-103476.

Matting Agent

A matting agent may be included in the image formation layer. In the case where the support has cushioning properties, or where a cushion layer described later to which a surface roughening process has not been carried out is provided on the support, it is preferable that a matting agent is added to the image formation layer in order to achieve roughening of the surface. The matting agent may be inorganic or organic particles. Examples of the inorganic particles include: metallic salts such as, silica, titanium oxide, aluminum oxide, zinc oxide, magnesium oxide, barium sulfate, magnesium sulfate, aluminum hydroxide, magnesium hydroxide, boron nitride, kaolin, clay, talc, zinc white, white lead, zeeklite, quartz, diatom earth, pearlite, bentonite, mica, synthesized mica and the like. Examples of the organic particles include resin particles such as: fluoroplastic particles, guanamine resin particles, acrylic resin particles, styrene-acrylic resin copolymer particles, silicone resin particles, melamine resin particles, epoxy resin particles and the like.

Further, at the time of image transfer, the thermal transfer sheet and the image receiving sheet are superimposed and pressure is applied or heat and pressure are both applied. If at this time, a matting agent which will be crushed when this pressure is applied is included in the thermal transfer sheet, a cushioning effect can be obtained without imparting cushioning properties to the support or providing a cushion layer.

Examples of the matting agent which will crush when pressure is applied include those particles from which materials having rubber elasticity are formed. Specific examples include elastomers such as: acrylate rubber, butyl rubber, nitrile rubber, butadiene rubber, isoprene rubber, styrene-butadiene rubber, chloroprene rubber, urethane rubber, silicone rubber, acrylic rubber, fluororubber, neoprene rubber, cholorosulfonated polyethylene, epichlorhydrin, EPDM and the like. Further, examples of the matting material which will crush when heat and pressure are applied include particles which form waxes having low hardness such as: paraffin wax, bees wax, waxes having a high oil content, and other waxes in which content of low molecular weight substances is high. The thermal transfer sheet which has been roughened by the wax particles is manufactured at a temperature which is 10° C. or more lower than the melting initiation temperature of the wax particles.

The particle diameter of the matting agent is usually 0.3–30 μm and preferably, 0.5–20 μm, and the amount to be used is 0.1–100 mg/m$^2$.

The thickness of the image formation layer is usually in the range of 0.1–3 μm and preferably in the range of 0.2–1.5 μm.

Light-Heat Conversion Layer

The light-heat conversion layer may contain a light-heat conversion colorant as its light-heat conversion substance. Examples of the light-heat conversion colorants which can be used include: indolenine dyestuff, polymethine dyestuff, phthalocyanine dyestuff, naphthalocyanine dyestuff, squalirium dyestuff, cyanine dye, nitroso compounds and metallic complex salts, thiolnickel salts, triallylmethane dyestuff, immonium dyestuff, naphthoquinone dyestuff, anthraquinone dyes, anthracene dyestuff, azulene dyestuff and the like. Specifically, examples include the compounds disclosed in the following publications: Japanese Patent Application Laid Open (JPA) Nos. 62-87388, 63-264395, 63-319191 & 64-33547, 1-160683, 1-280750, 1-293342, 2-2064, 2-2074, 3-26593, 3-30991, 3-30992, 3-34891, 3-36093, 3-36094, 3-36095, 3-42281, 3-63185, 3-97589, 3-97590, 3-97591, 3-103476, 3-124488, 3-132391, 4-140191, 4-161382, 4-169289, 4-169290, 4-173290, 4-173291, 5-32058, 5-201140, 5-221164, 5-338358, 6-24143, 6-32069, 6-115263, 6-210987, 6-255271, 6-309695, 7-101171, 7-149049, 7-172059, 7-195830, 9-58143, 9-80763, 10-207065, 10-268512, 11-95026, and 11-302610. Further the light-heat conversion layer may include two or more types of dyestuff which absorb infrared light.

The amount of light-heat conversion colorant in the light-heat conversion layer is usually 10–50% by weight, and preferably 15–25% by weight. In the present invention, it is preferable to adjust the amount so as to obtain maximum absorbance of the light-heat conversion layer in the near infrared region (wavelengths of approximately 760 nm–2500 nm) of 0.5 or more.

The binder to be used in the light-heat conversion layer is a resin having a high glass transition point and a high heat conductivity. Examples of such resins generally used include heat resistant resins such as polymethyl metacrylate, polycarbonate, polystyrene, ethylcellulose, nitrocellulose, polyvinyl alcohol, polyvinyl chloride, amide resins, polyimide, polyether imide, polysulfone, polyether sulfone, aramid and the like. Among these, polyvinyl alcohol is particularly preferable since scattering of the light-heat conversion layer does not tend to occur.

The thickness of the light-heat conversion layer is preferably within a range of 0.01–3 μm and more preferably, within a range of 0.1–0.5 μm. Further, maximum absorbance (optical density) in the 760–900 nm wavelength region, of the light-heat conversion layer is preferably greater than or equal to 0.3 and more preferably greater than or equal to 0.5.

Cushion Layer

A cushion layer may be provided between the support and the light-heat conversion layer. In a case where dimensional stability is required, or where a substance having a low modulus of elasticity is used, it is better to provide a cushion layer on a support which does not having cushioning properties, than to impart cushioning properties to the support. Examples of materials for the cushion layer are the same as those given as examples for forming a support having cushioning properties.

The thickness of the cushion layer is usually 10–100 μm. However, the thickness is not limited thereto. It is preferable that the thickness be appropriately selected in consideration various factors such as the type of elastomer, suction force at the time of adhesion, the particle size of the matting agent, and the amount of the matting agent used.

The method for forming the cushion layer is a coating method in which a blade coater, a roll coater, a bar coater, a curtain coater, a gravure coater, or the like is used is to coat components dissolved in a solution or made into a latex and dispersed therein or by an extrusion method.

By providing the cushion layer, adhesion property is improved, but there is very little change in the amount of time to reduce pressure when vacuum adhesion is carried out. Conversely, if pressure is decreased too suddenly, generation of air pockets is induced. It is preferable that roughening of the thermal transfer sheet is carried out in order to both ensure sufficient adhesion, and to reduce the amount of time needed for vacuum adhesion. In order to roughen the surface of the thermal transfer sheet, a roughening process is carried out in advance on the surface of the cushion layer before a light-heat conversion layer and an image formation layer are provided, or a matting agent can be included at the surface of the thermal transfer sheet. It is preferable that the degree of roughening be determined based on the elasticity of the cushion layer, the thickness of the film, the force of the pressure applied (degree of vacuum) and the surface roughness of the thermal transfer sheet, the particle diameter of the matting agent, and the amount of the matting agent used.

The roughness of the surface of the cushion layer depends on the material which forms the cushion layer, but a surface roughness in the range of Ra=0.3–10 μm is preferable. This is applied in a case where the surface of the thermal transfer sheet is roughened.

Scatter Prevention Layer

A scatter prevention layer may be provided in order to prevent the light heat conversion substance or the binder from scattering due to the heat generated when the light-heat conversion layer rapidly absorbs light energy when a laser or other high intensity energy is used as a light source. The scatter prevention layer is preferably formed from a material having sufficient strength to suppress the scattering of the light heat conversion layer with a thin film and having high heat conductivity in order to quickly conduct the heat generated at the light conversion layer to the image formation layer. The scatter prevention layer may be formed from a general heat resistant resin such as those used for the binder in the light-heat conversion layer. However, of those resins, polyvinyl alcohol is preferable since it is very effective in preventing scattering, it can be dissolved in water and then used for coating, and there is little mixing with the image formation layer and the light heat conversion layer.

Further, in a case where light is irradiated from the side of the support of the light heat conversion sheet, the scatter prevention layer may be opaque. Metallic vapor deposit films such as an aluminum film and the like are also effective in scatter prevention. The thinner the scatter prevention layer, the higher the sensitivity, and the thicker the scatter prevention layer, the better the scatter prevention effect. Generally, the thickness of the scatter prevention layer is 0.05–1.0 μm.

Peel Layer

A peel layer may be provided between the light-heat conversion layer and the image formation layer. By providing the peel layer, the peeling of the image formation layer at the time of the heat sensitive transfer recording is facilitated and a high quality image may be obtained. The peel layer may be formed only of a compound which melts when heat is applied but usually, it is preferably formed of this compound and/or a binder resin such as a thermoplastic resin and the like.

The compound which melts when heat is applied, and which is the main component of the peel layer, may be suitably selected from known compounds. Specific examples are the substances disclosed in Japanese Patent Application Laid-Open (PA) No. 63-193886 from line 8 of the upper left column of page 4, to line 12 of the right lower column of the same page. Specific examples of the thermoplastic resin include: ethylene copolymers such as ethylene-vinyl acetate resins, polyamide resins, polyester resins, polyurethane resins, polyolefin resins, acrylic resins and cellulose resins. Other examples of substances which may be used in some cases are resins such as vinyl chloride resins, rosin resins, petroleum resins and ionomer resins; elastomers such as natural rubber, styrene-butadiene rubber, isoprene rubber and chloroprene rubber; ester gum; rosin derivatives such as rosin-maleic acid resin, rosin-phenol resin, and hydrogenated rosin; and phenol resin, turpene resin, cyclopentadiene resin, and aromatic resins.

In the present invention, of those, the thermoplastic resin having a melting point or a softening point within a range of 50–150° C., and more specifically within a range of 60–120° C. is preferably used in the peel layer. Two or more thermoplastic resins which by being mixed, obtain a melting or softening point in the above range may be also suitably used.

Manufacturing of the Thermal Transfer Sheet

In order to form the thermal transfer sheet of the present invention, first, the above-described components of each of the layers which form the sheet are mixed while being heated or else dispersed or dissolved in a solvent to thereby prepare a coating solution for each of the respective layers. Then, these coating solutions are sequentially coated on the surface of the support and where necessary, the solvent is dried. The desired thermal transfer sheet is thereby obtained.

Examples of the solvent for preparing the coating solution include: water, alcohols such as methanol, ethanol, n-propanol, isopropanol, n-butanol, sec-butanol, 1-methoxy-2-propanol and the like; cellosolves such as methyl cellosolve, ethyl cellosolve and the like; aromatic compounds such as toluene, xylene, and chlorobenzene; ketones such as acetone and methyl ethyl ketone; esters such as ethyl acetate and butyl acetate; ethers such as tetrahydrofuran, dioxane, and chlorine-containing solution such as chloroform, trichloroethylene and the like.

The coating method may be a known coating method which uses a gravure roll, an extrusion coating method, a wire bar coating method, a roll coating method and the like.

The image formation layer may be formed as a layer with the entire surface of the support, or a portion of the surface of the support having a monochrome colorant. It may also be a yellow image formation layer having a binder and a yellow dyestuff, a magenta image formation layer having a binder and a magenta dyestuff, and a cyan image formation layer having a binder and a cyan dyestuff repeatedly formed a fixed number of times, on the entire surface of the support, or on a portion of the surface of the support in the planar direction thereof. All these layers may be laminated.

In order to facilitate use, perforations may be formed in the thermal transfer layer, or a detection mark may be provided in order to detect the position of the different color regions.

Image Receiving Sheet

The structure of the image receiving sheet of the present invention, is such that at least an image receiving layer and a cushion layer are disposed on top of the support. As needed, either of a peel layer and an intermediate layer may be disposed between the support and the image receiving layer. Further, in view of conveyance and the like, it is preferable that the surface opposite to that of the image receiving layer has a back coat. Also, in addition to these layers, an antistatic layer maybe provided, or an antistatic agent may be included in any of the above layers.

The Support

A sheet-like base such as a plastic sheet, paper, a metal sheet, a glass sheet, and the like is used as the support. Examples of the plastic sheet that may be used include: polyethylene terephthalate (PET), polyethylene naphtalate, polyethylene, polycarbonate, polyvinyl chloride, polyvinylidene chloride, polystyrene and the like. Polyethylene terephthalate is particularly preferable. Further the paper used may be the paper for printing or may be a coated sheet. The thickness of the support of the image receiving sheet is preferably 10–400 $\mu$m and more preferably 25–200 $\mu$m. Further, from the viewpoint of cushioning properties, visibility of the images and the like, the support of the present invention is preferably a white material having air spaces and the like in its inner portion. From the viewpoint of mechanical characteristics as well as the above points, a foam PET or a foam polyester support is more preferable. Also in order to increase adhesion of the surface of the support with the image receiving layer, the surface of the support may be exposed to surface treatments such as a corona discharge treatment, a glow discharge treatment or the like.

The Image Receiving Layer

The image receiving layer is a layer having as its main component, a binder which is an organic polymer. The binder is preferably a thermoplastic resin, examples of which include: homopolymers and copolymers of acrylic monomers such as acrylic acid, metacrylic acid, acrylate, metacrylate; cellulose polymers such as methyl cellulose, ethyl cellulose and cellulose acetate; homopolymers and copolymers of vinyl monomers such as polystyrene, polyvinyl pyrolidone, polyvinyl butyral, polyvinyl alcohol and polyvinyl chloride; condensed polymers such as polyester and polyamide; and rubber polymers such as butadiene-styrene copolymer. The binder for the image receiving layer is preferably a polymer having a glass transition temperature (Tg) less than 90° C. in order to obtain suitable bonding between the image formation layer and the image receiving layer. For this reason, the image formation layer may include a plasticizer. Further, in order to prevent blocking between the sheets, the Tg of the binder polymer of the image receiving layer is preferably greater than or equal to 30° C. In order to improve adhesion between the image formation layer and the image receiving layer at the time of laser recording, from the viewpoint of improving sensitivity and image strength, it is particularly preferable that the binder polymer of the image receiving layer is the same binder polymer of the image receiving layer or else one of a similar type.

The thickness of the image receiving layer is preferably 0.3–7 $\mu$m, and more preferably 0.7–4 $\mu$m. In the case where the thickness less than 0.3 $\mu$m, the film strength at the time of re-transfer on printing paper is insufficient, and as a result the printing paper tears easily. If the image receiving layer is too thick, the glossiness of the image which has been re-transferred increases and the likeness of the transferred image to the printed product decreases.

The Cushion Layer

The cushion layer is a layer that deforms easily when force is exerted on the image receiving layer. At the time of laser thermal transfer, adhesion between the image formation layer and the image receiving layer is thereby improved, and this has the effect of improving image quality. Further, even if a foreign object gets between the thermal transfer sheet and the image transfer sheet at the time of recording, due to the deformation of the cushion layer, the space between the image receiving layer and the image formation layer is reduced and this has the effect of reducing the size of the white missing defect. Further, in the case where after image transfer and formation has been carried out once, the image is again transferred to another printing paper, the likeness of the image to the printed image is increased. This is because the transferablity of the image receiving layer is increased as a result of the deformation of the image receiving surface in accordance with unevenness of the paper surface, and also because of the decreased glossiness of the image to be transferred.

A material having a low modulus of elasticity, a material having rubber elasticity, or a thermoplastic resin which softens easily when heated, is used to impart cushioning properties.

The modulus of elasticity is preferably 10–1500 MPa at room temperature and more preferably in the range of 30–500 MPa. Further, in order to introduce rubber and other foreign substances in the cushion layer, a penetration equal to or greater than 10 (for 10 g at 25° C. for 5 seconds), in accordance with JIS K2530, is preferable. Further the glass transition temperature of the cushion layer is preferably less than or equal to 80° C. and more preferably, less than or equal to 25° C. A plasticizer may be favorably added to the foreign substance in order to regulate the glass transition temperature.

Specific examples of the binder for the cushion layer include: rubbers such as urethane rubber, butadiene rubber, nitrile rubber, acrylic rubber, natural rubber, as well as polyethylene, polypropylene, polyester, styrene-butadiene copolymers, ethylene-vinyl acetate copolymer, ethylene-acryl copolymer, vinyl chloride-vinyl acetate copolymer, vinylidene chloride resin, vinyl chloride resin with a plasticizer, polyamide resin, phenol resin and the like.

The thickness of the cushion layer may vary in accordance with the resin used as well as with other conditions, but usually, it is preferable that the thickness is 3–100 $\mu$m and more preferably 10–52 $\mu$m.

It is necessary for the cushion layer to be adhered to the image receiving layer up until the stage of laser recording.

However, it is preferable that the cushion layer be peelable in order for an image to be transferred to the printing paper. In order to facilitate peeling, it is preferable that a peel layer having a thickness of about 0.1 μm to 2 μm be provided between the cushion layer and the image receiving layer. This peel layer preferably can function as a barrier to the coating solution when the image receiving layer is coated.

The structure of the above-described image receiving sheet is such that it includes a support, a cushion layer, and an image receiving layer, but the structure may also be such that there is a support/cushioning image receiving layer which serves as a cushion layer. The structure may also be such that there is a support/undercoat/cushioning image receiving layer. In these cases too, it is desirable that the cushioning image receiving layer be peelable in order that the images may be re-transferred to the printing paper. In these cases, after the second transfer of the images to the printing sheet, the images obtained are excellent in glossiness. The thickness of the image receiving-cushion layer is preferably 5–100 μm and more preferable 10–40 μm.

In the case where after the image is formed on the image receiving layer, it is re-transferred onto printing paper, it is preferable that at least one of the image receiving layers is formed of a material having light hardening properties. Examples of groups of these materials having light hardening properties include: a) a photopolymerizable monomer which each can be formed from at least one type of a multifunctional vinyl monomer and a vinylidene compound, and which can each become a photopolymer due to addition polymerization or; b) an organic polymer; and c) photopolymerization initiator and as necessary, an additive such as an thermal polymerization inhibitor and the like. Examples of the above multifunctional vinyl monomers which may be used include: unsaturated esters of polyol, particularly, esters of acrylic acid and metacrylic acid (eg. Ethylene glycol diacrylate, pentaerythritol tetracrylate).

Examples of the organic polymer are the same as those listed for use in forming the image receiving layer. Further, the photopolymerization initiator may be an ordinary photoradical polymerization initiator such as benzophenone, Michler's ketone and the like in an amount equal to 0.1–20% by weight.

Additives may be included in the above-described layers as necessary. For example, an anti-static agent of a surfactant or tin oxide particles, a matting agent of silicon dioxide or PMMA particles and the like may be included in the back layer on the support, from the viewpoint of improving conveyance in the recording device. These additives may be included not only in the back layer, but may be included in other layers such as the image receiving layer as necessary. Due to varying objectives, the type of additive cannot be specified unconditionally. However, for a matting agent, the average particle size may be 0.5–1 μm and the amount included in the layer may 0.5–80% by weight. An anti-static agent may be suitably selected from a surfactant and a conductive agent such that surface resistance is less than or equal to $10^{12}$ Ω, and more preferably less than or equal to $10^{9}$ Ω under the conditions of temperature being 23° C. and relative humidity being 50%.

Laminate for the Image Formation Layer

The laminate for image formation comprising the thermal transfer sheet and the image formation sheet of the present invention may be formed using various methods. For example, the image formation layer side of the thermal transfer sheet and the image receiving side of the image receiving sheet (image receiving layer side) may be superposed and rolled with a pressure-heat roller to thereby easily obtain the laminate for image formation. In this case, the laminate must be heated to a temperature less than or equal to 160° C. or less than or equal to 130° C.

Vacuum suctioning is also favorable as another method for obtaining the laminate for image formation. In this method an image formation sheet is first wound onto a drum which has provided thereon suction holes for vacuuming. Next, a thermal transfer sheet which is slightly larger in size than the image receiving sheet is vacuum adhered to the image receiving sheet while being pressed by a squeeze roller so as to uniformly expel air from therebetween.

Also, there is another method in which the image receiving sheet is mechanically brought in contact with the surface of a metal drum while being stretched. Further, the thermal transfer sheet is mechanically stretched while being brought in contact with the image receiving sheet in a similar manner and then they are adhered. Of these methods, since temperature regulation of the heat roller and the like is unnecessary and since it is speedy and obtaining a uniform laminate is facilitated, the vacuum adhesion method is particularly preferable.

Next, an image formation method which uses the thermal transfer sheet of the present invention will be described in detail. In the image formation method which uses the sheet of the present invention, a laminate for image formation is prepared in which an image receiving sheet is laminated onto a surface of the image formation layer of the thermal transfer sheet. The surface of this laminate is irradiated image-wise with a laser beam, in a time series. Subsequently, by the image receiving sheet and the thermal transfer sheet being peeled apart, an image receiving sheet to which the region of the image formation layer that was irradiated by the laser beam has been transferred is obtained. The thermal transfer sheet and the image receiving sheet may be bonded immediately before the laser irradiation is carried out. This laser irradiation is usually carried out by the image receiving sheet side of the laminate being adhered to the surface of the recording drum by vacuum suctioning, and in this state, the outer side, that is, the thermal transfer sheet side, is irradiated with laser light. (The recording drum is a rotation drum having at its inner portion a vacuum forming mechanism, and on its surface a plurality of small openings.) The irradiation of the laser light is scanned so as to go back and forth in a width direction of the drum. During the irradiation, the drum is rotated at a fixed angular speed.

Examples of the laser light which may be used include: gas laser light such as argon ion laser light, helium neon laser light, and helium cadmium laser light; solid laser light such as YAG laser light, and direct laser light such as semiconductor laser light, dyestuff laser light, and excimer laser light. Also, these laser lights may be passed through a secondary modulation element and converted to lights of half of the original wavelengths and then used. In the image formation method using the thermal transfer sheet of the present invention, in consideration of output force and ease of modulation, it is preferable that a semiconductor laser is used. Further, in the image formation method using the thermal transfer sheet of the present invention, it is preferable that radiation conditions are such that the beam diameter of the laser light on the light-heat conversion layer is in the range of 5–50 μm (more specifically 6–30 μm). Further, it is preferable that the scanning speed is greater than or equal to lm/sec (more specifically greater than or equal to 3 m/sec).

The image formation method using the thermal transfer sheet of the present invention may used for manufacturing a black mask or for formation of a monochrome image, but may also be advantageously used for formation of a multicolor image. In the image formation method using the thermal transfer sheet of the present invention, in order to form multicolor images, for example, the following method can be used. Three (three colors) or four (four colors) laminates for image formation having image formation layers with colorants of different colors are formed separately. Laser beam irradiation for these are carried out in accordance with digital signals based on images by a color separation filter. Following that, peeling of the image recording transfer sheets from the image receiving sheets is carried out and images of each of the colors are separately formed on the image receiving sheets. Then, the images of each of the colors are sequentially laminated on a separately provided support such as printing paper or the like, or on a similar support.

EXAMPLES

Hereinafter, the present invention will be described based on examples, but the present invention is not to be limited thereby. The organic pigments used in Examples 1 to 5 have melting points greater than or equal to 310° C., whereas the organic pigments used in Comparative Examples 1–3 have melting points less than 310° C. Unless stated otherwise parts refer to parts by weight.

Example 1

Preparation of the Thermal Transfer Sheet

1) Preparation of the Pigment Dispersion

The materials listed below were mixed in a paint shaker (manufactured by Toyo Seiki Seisaku-Sho, Ltd.) and the dispersion was carried out for 3 hours to thereby obtain a pigment dispersion having an average particle diameter of about 300 nm.

| | |
|---|---|
| •pigment: permanent yellow GG02 (PY17 manufactured by Clariant Japan Co., Ltd.) | 12.9 parts |
| •amorphous polymer: polyvinyl butyral (softening point: 58° C. Ethrec BL-SH manufactured by Sekisui Chemical Co., Ltd.) | 7.1 parts |
| •dispersion aid (Solusperse 20000 manufactured by ICI Japan) | 0.6 parts |
| •n-propyl alcohol | 79.4 parts |
| •3 mm diameter glass beads (dispersion medium) | |

2) Preparation of the Image Formation Coating Solution

The compositions listed below were mixed and stirred with a stirrer to thereby prepare the image formation coating solution.

| | |
|---|---|
| •pigment dispersion | 11.2 parts |
| •amorphous polymer: polyvinyl butyral (softening point :58° C. Ethrec BL-SH manufactured by Sekisui Chemical Co., Ltd.) | 0.3 part |
| •ultra light color rosin ester (KE 311 manufactured by Arakawa Chemical Co., Ltd.) | 0.2 part |
| •behenic acid (NAA-222S manufactured by NOF Corporation) | 0.2 part |
| •fluorine-containing surfactant (Megafac F-177P manufactured by Dainippon Ink & Chemicals Inc.) | 0.1 part |
| •methyl ethyl ketone (MEK) | 17.6 parts |
| •n-proply alcohol | 70.4 parts |

3) Preparation of the Light-Heat Conversion Layer Coating Solution

The compositions listed below were stirred with a stirrer and mixed to thereby prepare light-heat conversion layer coating solution

| | |
|---|---|
| •near infrared light absorption pigment NK-2014 manufactured by Nippon Kanko Shikiso Co.,Ltd) | 0.5 part |
| •polyimide (Rikacoat manufactured by New Japan Chemical Co., Ltd.) | 9.1 parts |
| •fluorine-containing surfactant (Megafac F-177P manufactured by Dainippon Ink & Chemicals Inc.) | 0.1 part |
| •n-methyl-2-pyrrolidine | 41.6 parts |
| •methyl ethyl ketone (MEK) | 48.8 parts |

4) Production of the Thermal Transfer Sheet

Polyethylene terephthalate (PET) having a thickness of 75 μm was used as a support and a coating solution for a light-heat conversion layer was coated thereon using a spin coater, and then dried. The dried film was then adjusted so as to have absorbance of 1.00 at a wavelength of 830 nm.

Further, the light-heat conversion layer was coated with a coating solution for an image formation layer, using a spin coater, such that the thickness of the dried film was 0.3 μm and then dried to thereby form an image formation layer. The amount of the organic pigment in the image formation layer was 46.5% by weight and the amount of the amorphous polymer was 35.2% by weight.

Production of the Image Receiving Sheet

A coating solution for an intermediate layer having cushioning properties and an image receiving layer coating solution having the composition below were prepared.

1) Preparation of a Coating Solution for the Intermediate Layer Having Cushioning Properties The components listed below were mixed by being stirred with a stirrer to thereby prepare the coating solution for the intermediate layer having cushioning properties.

| | |
|---|---|
| •vinyl chloride-vinyl acetate copolymer Solubine CL2 manufactured by Nissin Chemical Industry Co.,Ltd. | 15.1 parts |
| •Paraplex G40 (manufactured by The C.P.HallConpany) | 16.9 parts |
| •fluorine-containing surfactant (Megafac F-176PF manufactured by Dainippon Ink & Chemicals Inc. | 0.5 part |
| •methyl ethyl ketone (MEK) | 51.3 parts |
| •toluene | 13.7 parts |
| •dimethyl formaldehyde | 2.5 parts |

2) Preparation of Image Receiving Layer Coating Solution

The components listed below were mixed by being stirred with a stirrer to thereby prepare a coating solution for the image receiving layer.

| | |
|---|---|
| • polyvinyl butyral • (Ethrec BL-SH manufactured by Sekisui Chemical Co., Ltd.) | 7.9 parts |
| • n-propyl alcohol | 22.8 parts |
| • MFG | 20.9 parts |
| • Methanol | 48.3 parts |

3) Formation of the Image Receiving Sheet

The coating solution for the cushioning intermediate layer is coated with a spin coater on a support having air spaces, (a PET foam base, Product name: Lumiler E58L manufactured by Toray Co., Ltd.), until the thickness of the dry film was 18 μm. The film was then dried and an intermediate layer having cushioning properties was thereby formed.

Next, the coating solution for the image receiving layer was coated onto the cushioning intermediate layer which was formed, using a spin coater until the thickness of the film when dry was 2 μm. The film was then dried and the image receiving layer and the image receiving sheet was thereby formed.

Production of the Laminate for Image Formation

The image receiving layer of the image receiving sheet and the image formation layer of the thermal transfer sheet are superposed to thereby fabricate the laminate.

Example 2

The thermal transfer sheet was produced by the same method as Example 1, except that Noveperm Yellow H2G (Y120 manufactured by Clariant Japan) was used as the pigment in the pigment dispersion.

Example 3

The thermal transfer sheet was produced by the same method as Example 1, except that Noveperm Yellow M2R70 (Y139 manufactured by Clariant Japan) was used as the pigment in the pigment dispersion.

Example 4

The thermal transfer sheet was produced by the same method as Example 1, except that Noveperm Yellow 5GD (Y155 manufactured by Clariant Japan) was used as the pigment in the pigment dispersion.

Example 5

The thermal transfer sheet was produced by the same method as Example 1, except that Noveperm Yellow P-HG (Y180 manufactured by Clariant Japan) was used as the pigment in the pigment dispersion.

Comparative Example 1

The thermal transfer sheet was produced by the same method as Example 1, except that Permanent Yellow DHG (Y12 manufactured by Clariant Japan) was used as the pigment in the pigment dispersion.

Comparative Example 2

The thermal transfer sheet was produced by the same method as Example 1, except that Permanent Yellow GR (Y13 manufactured by Clariant Japan) was used as the pigment in the pigment dispersion.

Comparative Example 3

The thermal transfer sheet was produced by the same method as Example 1, except that Permanent Yellow G (Y14 manufactured by Clariant Japan) was used as the pigment in the pigment dispersion.

Image Recording

Recording is carried out on the thermal transfer sheets and the image receiving sheets of Examples 1 to 5 and Comparative Examples 1 to 3, by TC-P 1080 (Manufactured by Dainippon Screen Mfg. Co., Ltd.). The thermal transfer sheet and the image receiving sheet are disposed on the drum in order that the image formation layer and the image receiving layer face each other, and are fixed by vacuum suctioning and then recording is carried out using a laser beam having a wavelength of 830 nm. (The radiation energy at the support surface of the thermal transfer sheet is 300 mJ/cm$^3$.)

After the laser recording is carried out, the thermal transfer sheet and the image receiving sheet are peeled from each other and images are transferred on the image receiving sheet Evaluation Evaluation of Transferability The optical reflection density r of the image formation layers before the laser is irradiated, are measured by a Macbeth densitometer (blue filter). Further, the optical density R of the image formed on the image receiving sheet is measured in the same manner.

From the r and R values obtained, the respective image transfer rates for laser thermal transfer is determined using the following formula.

$$\text{Image transfer rate}=(R/r)\times 100$$

The results obtained, as well as the melting point of the organic pigment used in each of the thermal transfer sheets and the optical density and the DIN54001 heat resistance of the thermal transfer sheets are shown in Table 1.

2) Hue Evaluation

The hue of the image on the image receiving sheet was judged according to the standard below by being viewed.

very good
average
somewhat poor
poor
very poor

TABLE 1

| | Image transfer rate | Melting point of pigment | Hue | OD | Heat Resistance* |
|---|---|---|---|---|---|
| Example 1 | 100% | 315 | B | 1.0 | 200 |
| Example 2 | 100% | 320 | B | 1.0 | 200 |
| Example 3 | 100% | 340 | A | 1.0 | 200 |
| Example 4 | 100% | 325 | B | 1.0 | 220 |
| Example 5 | 100% | 350 | A | 1.0 | 220 |
| Comparative Example 1 | 73% | 280 | D | 1.0 | 140 |
| Comparative Example 2 | 75% | 300 | D | 1.0 | 180 |
| Comparative Example 3 | 70% | 300 | D | 1.0 | 180 |

*heat resistance is according to DIN 54001

As shown in Table 1, if the melting point of the organic pigment which is included in the image formation layer is greater than or equal to 310° C., image transfer rate is improved. Further, it is understood that as the melting point of the organic pigment increases, the hue becomes better.

What is claimed is:

1. A thermal transfer sheet comprising at least an image formation layer disposed on a support, wherein the image formation layer includes an organic pigment having a melting point not less than 320° C.; and a light-heat conversion layer which converts light to heat disposed on a support, wherein the light-heat conversion layer has an absorbance in the near infrared light region of not less than 0.5, wherein the organic pigment is an organic pigment selected from the group consisting of Y120 (Pigment Yellow 120), Y180 (Pigment Yellow 180), Y139 (Pigment Yellow 139) and Y155 (Pigment Yellow 155).

2. A thermal transfer sheet according to claim 1, further comprising at least an image formation layer disposed on a support, wherein the heat resistance of the image formation layer according to the DIN 54001 standard is not less than 200° C.

3. The thermal transfer sheet of claim 2, wherein an amount of an organic pigment and an amorphous organic polymer having a softening point in the range of 40–150° C. included in the image formation layer is 30 to 70% by weight, and 70 to 30% by weight respectively, and the thickness thereof is in the range of 0.2 to 1.5 μm.

4. A thermal transfer sheet according to claim 3, wherein said amorphous organic polymers is at least one of butyral resin, polyamide resin, polyethylene imine resin, sulfonamide resin, polyester polyol resin, petroleum resin, homopolymer and copolymers of styrenes and derivatives thereof such as styrene, vinyltoluene, γ-methylstyrene, 2-methylstyrene, chlorostyrene, vinylbenzoic acid, sodium vinylbenzenesulfonate, aminostyrene; homopolymers of vinyl and vinyl derivatives and copolymers of vinyl and vinyl derivatives (e.g. metacrylates such as methyl metacrylate, ethyl metacrylate, butyl metacrylate, hydroxyethyl metacrylate, and metacrylic acid acrylates such as methyl acrylate, ethyl acrylate, butyl acrylate, γ-ethylhexyl acrylate and acrylic acid, dienes such as butadiene and isoprene, acrylonitrile, vinyl eters, maleic acid and maleic acid esters, maleic anhydride, cinnamic acid, vinyl chloride, and vinyl acetate).

5. A thermal transfer sheet of claim 1, wherein an amount of an organic pigment and an amorphous organic polymer having a softening point in the range of 40–150° C. included in the image formation layer is 30 to 70% by weight, and 70 to 30% by weight respectively, and the thickness thereof is in the range of 0.2 to 1.5 μm.

6. A thermal transfer sheet according to claim 5, wherein said amorphous organic polymers is at least one of butyral resin, polyamide resin, polyethylene imine resin, sulfonamide resin, polyester polyol resin, petroleum resin, homopolymer and copolymers of styrenes and derivatives thereof such as styrene, vinyltoluene, γ-methylstyrene, 2-methylstyrene, chlorostyrene, vinylbenzoic acid, sodium vinylbenzenesulfonate, aminostyrene; homopolymers of vinyl and vinyl derivatives and copolymers of vinyl and vinyl derivatives (e.g. metacrylates such as methyl metacrylate, ethyl metacrylate, butyl metacrylate, hydroxyethyl metacrylate, and metacrylic acid acrylates such as methyl acrylate, ethyl acrylate, butyl acrylate, γ-ethylhexyl acrylate and acrylic acid; dienes such as butadiene and isoprene, acrylonitrile, vinyl eters, maleic acid and maleic acid esters, maleic anhydride, cinnamic acid, vinyl chloride, and vinyl acetate).

7. A thermal transfer sheet according to claim 1, wherein an image receiving sheet comprising at least a cushion layer and an imaging receiving layer disposed on a porous support is disposed on said thermal transfer sheet.

8. A thermal transfer sheet according to claim 4, wherein said cushion layer has a roughness of 0.3 to 10 μm.

9. A thermal transfer sheet according to claim 1, wherein said support is transparent.

10. A thermal transfer sheet according to claim 1, wherein the thickness of said support is between 16–300 μm.

11. A thermal transfer sheet according to claim 1, wherein a back coat is provided on said support opposite the heat conversion layer wherein said back coat imparts stability at time of movement, heat resistance, and anti-static properties.

12. A thermal transfer sheet according to claim 1, wherein said image formation layer comprises a binder, wherein said binder is an amorphous organic polymer having a softening point of 40–150° C.

13. A thermal transfer sheet according to claim 1, wherein said image formation layer comprises an organic or inorganic matting agent which is crushed at the time of image transfer.

14. A thermal transfer sheet according to claim 1, wherein a matting agent is applied to said image formation layer; and wherein said matting agent roughens the surface of said image formation layer.

15. A thermal transfer sheet according to claim 14, wherein the particle size of said matting agent is 0.5–1 μm.

16. A thermal transfer sheet according to claim 1, wherein the thickness of said support is between 50–100 μm.

17. A thermal transfer sheet according to claim 1, wherein said thermal transfer sheet is a melt type transfer sheet.

* * * * *